United States Patent [19]

Hanf

[11] 3,993,924

[45] Nov. 23, 1976

[54] DELAY LINE FOR TRAVELING WAVE TUBES

[75] Inventor: Fritz Hanf, Munich, Germany

[73] Assignee: Siemens Aktiengesellschaft, Berlin & Munich, Germany

[22] Filed: Jan. 23, 1975

[21] Appl. No.: 543,527

[30] Foreign Application Priority Data

Feb. 14, 1974 Germany ..... 2407075

[52] U.S. Cl. ..... 315/3.5; 315/3.6; 315/39.3; 333/31 A

[51] Int. Cl.[2] ..... H01J 25/34

[58] Field of Search ..... 315/3.5, 3.6, 39.3; 333/31 A

[56] References Cited

UNITED STATES PATENTS

| | | | |
|---|---|---|---|
| 2,945,981 | 7/1960 | Karp | 315/3.5 |
| 3,387,168 | 6/1968 | Beaver | 315/3.5 |
| 3,397,339 | 8/1968 | Beaver et al. | 315/3.6 |
| 3,646,389 | 2/1972 | Hentschel | 315/3.5 |
| 3,693,038 | 9/1972 | Scott et al. | 315/3.5 |
| 3,876,962 | 4/1975 | Hiramatsu et al. | 333/31 A |

*Primary Examiner*—Saxfield Chatmon, Jr.
*Attorney, Agent, or Firm*—Hill, Gross, Simpson, Van Santen, Steadman, Chiara & Simpson

[57] ABSTRACT

A delay line for traveling wave tubes comprises a rectangular wave guide having cross members which perpendicularly protrude into the wave guide interior extending alternately from two sides facing each other of a first pair of inner wave guide walls. The wave guide inner wall includes a recess extending in the longitudinal direction of the wave guide and disposed symmetrically at both sides of the longitudinal extension of the cross members, at least in the area of their ends. Such a delay line construction provides for the provision of a magnet surrounding the line which may have a comparably small inside diameter.

2 Claims, 2 Drawing Figures

DELAY LINE FOR TRAVELING WAVE TUBES

BACKGROUND OF THE INVENTION

1. Field of the Invention

This invention relates to a delay line for traveling wave tubes comprising a rectangular wave guide having cross members which extend perpendicularly into the interior of the wave guide. The cross members alternately originate from two inner wall surfaces of the wave guide which face each other.

2. Description of the Prior Art

Delay lines of the type generally described are known in the art in a variety of embodiments. For example, one may refer to the German DAS 1,130,936.

As to the provision of a rectangular shape of a wave guide, reference may be taken to the German DAS 1,243,280.

Delay lines are usually surrounded with radially symmetrically constructed magnets (permanent magnets, coils) in order to produce for the electron beam, which interacts with the following HF wave, a guide field which is as free of cross components as possible. For reasons of a low unit power (required magnetic weight for the development of a certain field of intensity on the axis of the electron beam) the magnet should be positioned as closely as possible to the electron beam. With delay lines having a rectangular form of construction, the smallest possible inner diameter of the magnet is determined by the greatest cross dimension of the line; that is, it is determined by the diagonal through the inside diameter of the line plus a certain amount for the necessary minimum wall thickness of the wave guide.

SUMMARY OF THE INVENTION

The primary object of the invention is to provide a delay line of the type generally mentioned above such that, while maintaining the transmission characteristic, the guide magnet surrounding the line can have a smaller inner diameter.

In accomplishing the foregoing objects, the invention provides that, with a delay line of the type initially mentioned above, the inner wall of the wave guide has a longitudinally extending recess disposed symmetrically at both sides of the longitudinal extension of a plurality of cross members, at least in the area of the ends of the cross members.

In order to determine the desired transmission features, the conductor types described in the prior art are frequently carried on opposite sides of the wave guide (usually on the broad sides of the wave guide) on a member which extends in the longitudinal direction of the wave guide axis and extending inwardly up into proximity with the path of the electron beam. For example, with helix-shaped line structures having a forward fundamental wave, the impedance effect of longitudinal members effect a band widening. Compare U.S. Pat. Nos. 3,142,777 or 3,433,999. With lines having a backward fundamental wave, for example, they reduce the dispersion of a +1. partial wave while restricting the transition range in a predetermined manner. Compare this to the above-mentioned German DAS 1,130,936 which describes a hollow wave guide with interdigitally arranged cross members.

According to the invention, such a dispersion correction is carried out in a different manner. Instead of having longitudinal members protrude from the two side walls, the side walls themselves are moved closer to the cross members while the great influencing of the dispersion characteristic, which is caused by this technique, is sufficiently compensated by providing recesses which act to balance the influence. As a result, the transmission characteristic can therefore be transformed to a qualitatively comparable extent and at the same time the diagonal between the corners of the wave guide rectangular cross section which determines the inside diameter of the magnet can be decreased. Altogether, in this manner one obtains a more compact, lighter and more economical tube which, in the case of a coil generated field, can be operated at a higher overall efficiency in that less coil current is required.

A delay line constructed according to the invention can be produced relatively easily and with relatively small tolerances in dimension; that is the delay line can be produced with less scattering in its electrical properties, since the insertion and mounting of additional longitudinal members is eliminated.

Actually, cross member lines having a round inner cross section are known in the art (German DAS 1,130,936) in which the line wall and the guide magnet, in contrast to rectangular lines, are form locking. However, in particular in case of solid wall thicknesses, cylindrical line forms are subjects of higher expenditures in production and to a lesser mode stability, and in addition, for a frequency-wise predetermined transmission band, such forms do not make possible a smaller inner diameter of the guide magnet.

BRIEF DESCRIPTION OF THE DRAWING

Other objects, features and advantages of the invention will be best understood from the following detailed description of an exemplary embodiment of the invention, taken in conjunction with the accompanying drawing, on which.

DESCRIPTION OF THE PREFERRED EMBODIMENT

Figure 1:
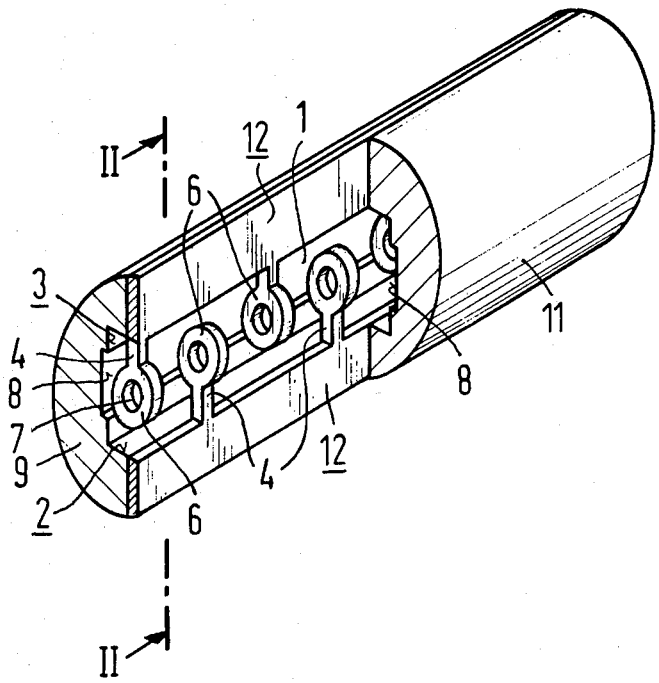
FIG. 1 is a perspective, partially sectional view of an exemplary embodiment of a delay line constructed in accordance with the invention.

It should be noted that portions of a delay line which are not essential for understanding the invention, for example its input coupling and output coupling portions, are not illustrated on the drawing for reasons of simplicity and clarity.

Referring to the drawing, the delay line illustrated is intended for a traveling wave amplifier tube and has a backward fundamental wave in the lowest frequency passband and is operated in the +1. partial wave. The line itself comprises a rectangular wave guide 1 having a first pair of inner walls 2 and a second pair of inner walls 3. It will be noted that the inner walls 2 lie facing each other, as do the inner walls 3, and are narrower than the inner walls 3.

Figure 2:
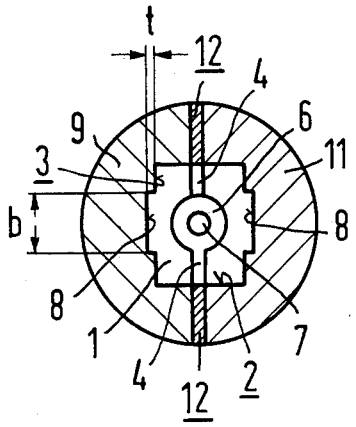
FIG. 2 is a sectional view taken substantially along the line II—II of FIG. 1.

A plurality of cross members 4, each of which includes a beam cylinder 6 and an opening 7 to define an electron beam path are provided and disposed such that the opening 7 are coaxial with respect to the longitudinal axis of the wave guide 1. The cross members 4 protrude alternately from the narrow sides 2 which face each other. With this construction, the outer diameter of the beam cylinder 6 is greater than the width of the remaining portion of the cross member 4, as is clearly evident from FIG. 2.

The two broad sides 3 of the wave guide 1 each have a longitudinal recess 8 which is set back a depth *t*. The width *b* of the recess 8 corresponds approximately to the outer diameter of the beam cylinder 6. In the case of beam cylinders or beam rings having a greater outer diameter than the cross members, the decrease of the diagonal which is achieved with the recess provided in accordance with the invention is particularly great.

The exemplary embodiment described herein and illustrated on the drawing can be produced very easily. Therefore, each half of the wave guide is worked out for example milled, at first from two solid semi-round metal members 9 and 11 consisting, for example, of copper, so that they form two longitudinal halves of the wave guide. Holding pieces 12 of sheet metal are then placed between the members 9 and 11. The holding pieces 12 carry the individual cross members 4 with the holes 7 aligned and soldered together with the two longitudinal halves 9 and 11. If necessary, parts of the holding pieces 12 which protrude beyond the outer wall of the longitudinal halves 9 and 11 may be removed and the exterior of the finished wave guide are to be turned so as to be faced cylindrically.

Although I have described my invention by reference to a particular illustrative embodiment thereof, many changes and modifications of the invention may become apparent to those skilled in the art without departing from the spirit and scope of the invention. I therefore intend to include with the patent warranted hereon all such changes and modifications as may reasonably and properly be included within the scope of my contribution to the art.

I claim:

1. In a delay line for traveling wave tubes of the type comprising interior walls defining a rectangular wave guide and having cross members which protrude perpendicularly into the interior of the wave guide alternately from two facing interior walls of the wave guide, the improvement therein comprising:

a pair of recesses in a pair of facing walls extending longitudinally of the wave guide, each of the recesses being provided in the area of the distal ends of the cross members, said wave guide having a first pair of interior walls and a second pair of narrower interior walls, wherein the cross members protrude alternately from the narrower walls of said rectangular wave guide and each includes a beam cylinder disposed coaxially with respect to the wave guide longitudinal axis and having an outer diameter which is greater than the width of the remaining portion of the cross member, and wherein said recesses are disposed in the first pair of interior walls of said rectangular wave guide and each has a width corresponding approximately to the outer diameter of the beam cylinders of the cross members.

2. A delay line for traveling wave tubes, comprising a pair of generally semicircular elongate members joined together to form a substantially cylindrical structure, first and second pairs of interior walls defining a rectangular wave guide, said first pair of said walls facing each other, each wall of said first pair being narrower than the walls of said second pair of walls, a pair of holding members sandwiched between and connected to said elongate members in the area of said first walls, each of said elongate members including a plurality of cross members which protrude into the interior of the wave guide, said cross members extending into the wave guide in an alternate arrangement from respective holding members, each of said cross members including a ring-shaped beam portion disposed coaxially with respect to the longitudinal axis of the wave guide and a supporting portion extending between the ring-shaped beam portion and the respective holding member, the supporting portion being narrower than the outer diameter of the ring-shaped portion, and means defining a pair of recesses in respective walls of the second pair of walls, each of said recesses extending longitudinally of the wave guide and having a width parallel to the direction of cross member protrusion that approximately corresponds to the outer diameter of the ring-shaped beam portions.

* * * * *